United States Patent [19]

Dorsch

[11] Patent Number: 5,076,757

[45] Date of Patent: Dec. 31, 1991

[54] HIGH HEAD CENTRIFUGAL SLICING SLURRY PUMP

[75] Inventor: Glenn R. Dorsch, Aberdeen, Wash.

[73] Assignee: Vaughan Co., Inc., Montesano, Wash.

[21] Appl. No.: 742,221

[22] Filed: Aug. 6, 1991

Related U.S. Application Data

[60] Continuation of Ser. No. 544,073, Jun. 26, 1990, abandoned, which is a division of Ser. No. 308,333, Feb. 8, 1989, abandoned, which is a division of Ser. No. 229,700, Jan. 29, 1981, Pat. No. 4,842,479.

[51] Int. Cl.[5] ..... F04D 29/06

[52] U.S. Cl. ..... 415/110; 415/170.1; 415/171.1; 415/225

[58] Field of Search ..... 415/170.1, 171.1, 174.2, 415/229, 230, 231, 110, 111, 225, 109

[56] References Cited

U.S. PATENT DOCUMENTS

| | | | |
|---|---|---|---|
| 768,911 | 8/1904 | Schoene | 415/171.1 |
| 2,463,886 | 3/1949 | Langmyhr | 366/343 |
| 2,477,096 | 7/1949 | Silcox | 241/46 |
| 2,714,354 | 8/1955 | Farrand | 415/121.1 |
| 2,787,960 | 4/1957 | Wightman | 415/171.1 |
| 2,815,590 | 12/1957 | Fiacco | 37/43 |
| 3,155,046 | 11/1964 | Vaughan | 415/206 |
| 3,255,793 | 6/1966 | Clute | 415/121.1 |
| 3,325,107 | 6/1967 | Peterson | 241/101 |
| 3,340,812 | 9/1967 | Schlesiger | 415/121.1 |
| 3,416,729 | 12/1968 | Ravitts et al. | 239/16 |
| 3,444,818 | 5/1969 | Sutton | 415/121.1 |
| 3,661,474 | 5/1972 | Sieghartner | 415/901 |
| 3,850,550 | 11/1974 | Kaessen | 415/111 |
| 3,973,866 | 8/1976 | Vaughan | 415/121.1 |
| 4,527,947 | 7/1985 | Elliott | 415/171.1 |
| 4,575,308 | 3/1986 | Corkill | 415/225 |
| 4,587,076 | 5/1986 | Bonhomme | 415/230 |
| 4,842,479 | 6/1989 | Dorsch | 415/121.1 |

FOREIGN PATENT DOCUMENTS

| | | | |
|---|---|---|---|
| 25037 | 9/1886 | Canada . | |
| 729917 | 3/1966 | Canada . | |
| 691148 | 4/1940 | Fed. Rep. of Germany . | |
| 810307 | 3/1937 | France . | |
| 1323707 | 3/1963 | France . | |
| 492190 | 3/1954 | Italy | 416/223 B |
| 62203 | 6/1978 | Japan | 415/171.1 |
| 901364 | 7/1962 | United Kingdom | 415/109 |
| 1551918 | 9/1979 | United Kingdom . | |

OTHER PUBLICATIONS

Wastewater and Raw Water Submersible Pumps, Bulletin No. C7301R, of Flygt Corporation, Norwalk, Conn., published 1977, (p. 3).

*Primary Examiner*—John T. Kwon

*Attorney, Agent, or Firm*—Ward Brown; Robert W. Beach

[57] ABSTRACT

The rotary drive shaft of a centrifugal pump extends vertically through a cylindrical housing and into a casing defining a bowl for the impeller of the pump. A mechanical seal and bearings for the drive shaft are positioned between the pump bowl and the interior of the housing which forms a reservoir for liquid lubricant. The impeller includes a radial shroud plate, a first set of pumping blades projecting downward from the shroud plate toward the axial pump inlet and a second set of blades or vanes projecting upward from the shroud plate. The upper vanes result in slight suction being generated in the area of the seal tending to draw lubricant from the housing reservoir through the bearings and seal. Seal failure is detected by a rapid decrease in the level of lubricant in the reservoir.

3 Claims, 3 Drawing Sheets

HIGH HEAD CENTRIFUGAL SLICING SLURRY PUMP

CROSS REFERENCE

This application is a continuation of my co-pending application Ser. No. 07/544,073, filed June 26, 1990, now abandoned, for High Head Centrifugal Slicing Slurry Pump, which application is a division of my application Ser. No. 07/308,333 filed Feb. 8, 1989, now abandoned, which application is a division of my application Ser. No. 06/229,700, filed on Jan. 29, 1981, issued June 27, 1989 as U.S. Pat. No. 4,842,479.

BACKGROUND OF THE INVENTION

1. Field of the Invention

The present invention relates to centrifugal pumps and particularly to centrifugal pumps effective for pumping slurries of liquid, usually water, and suspended solids constituting up to about 25 percent by weight of such slurries. Usually, the slurries have chunks or lumps of solid material that could clog or otherwise reduce the efficiency of a centrifugal pump so that such slurry pumps must have mechanism for comminuting the lumps or chunks to ensure effective and consistent pumping of the slurry.

2. Prior Art

The pump of the present invention is of the same general type as the "Centrifigual Chopping Slurry Pump" disclosed in U.S. Pat. No. 3,973,866 which is stated to be an improvement on the general type of pump disclosed in U.S. Pat. No. 3,155,046. The pumps of both of those patents are designed for pumping slurries containing chunks or lumps of solid material.

In general, each of the prior pumps has an upright drive shaft, the lower end portion of which projects downward into a substantially cylindrical pump casing. The impeller fixed to the drive shaft within the casing has a radial shroud disc or plate with downward projecting, generally radially extending blades or vanes. The bottom of the casing is closed by an end plate having arcuate inlet apertures for intake of slurry in an axial direction. The sharpened lower edges of the impeller blades cooperate with the leading edges of the inlet apertures for chopping chunks or lumps of solid material in the slurry being pumped. The slurry is accelerated circumferentially and outward to a generally tangential outlet conduit.

The pump disclosed in U.S. Pat. No. 3,973,866 also includes a screw propeller cantilevered from the pump drive shaft outside the pump casing and adjacent to the inlet apertures in the end plate. Such propeller has generally radial blades with somewhat sharpened leading edges for chopping chunks or lumps in the slurry. In addition, the screw propeller is stated to generate a positive current flow of slurry through the end plate inlet apertures.

Another aspect of the pump of U.S. Pat. No. 3,973,866 that is pertinent to the present invention is the use of elongated "slinger" ribs or vanes of small axial height projecting from the side of the impeller shroud plate opposite the lower primary pumping impeller blades. Such upper vanes are in the form of volute ribs for slinging away from the drive shaft bearing structure the solid material component of slurry which may work its way past the edge of the shroud plate so as to reduce wear of such bearing structure. See the paragraph beginning at column 2, line 21.

The prior pumps are of relatively low head and efficiency as compared to the pump of the present invention. In such pumps flow through the end plate inlet apertures into the impeller-receiving pump casing and out of the casing through the pump outlet is much more turbulent than in the pump of the present invention.

SUMMARY OF THE INVENTION

The principal object of the present invention is to provide an efficient, durable centrifugal pump having a high head characteristic and capable of consistent pumping of slurry containing solid chunks or lumps.

For accomplishing this object, improvements made to the pump disclosed in U.S. Pat. No. 3,973,866 include: changing the design of the bottom booster propeller so as to increase the head of the pump without decreasing the chopping effectiveness of such propeller; locating the booster propeller at the entrance to a downwardly flared funnel for effecting smooth gradual acceleration of slurry toward the inlet apertures; locating the inlet apertures closer to the axis of rotation of the impeller so as to eliminate or greatly reduce backflow of high-pressure slurry in the radially outer portion of the pump casing and increase the effectiveness of the impeller vanes to accelerate outward movement of the slurry; rounding the entrances to fair the inlet apertures for smooth flow into the pump casing; enclosing the impeller in a semicylindrical, semivolute casing, the volute portion being located immediately rearward of the pump outlet; sweeping back the impeller blades for providing an improved slicing action of the sharpened lower edges of the blades in cooperation with sharpened forward edges of the inlet apertures; decreasing the thickness of the impeller blades relative to the radial width of the inlet apertures so as not to interfere with intake of slurry through the inlet apertures; merging the impeller blades into the shroud plate with fillets for smooth, substantially nonturbulent acceleration of the slurry circumferentially and outward toward the pump outlet; cupping the leading faces of the impeller blades to ensure smooth change of direction of the slurry and effective slicing of chunks or lumps of solid material in the slurry; recessing the apertured end plate into the pump casing to dispose its inner surface flush with the adjoining surface of the pump outlet for smoother flow of slurry into the pump outlet; and arranging the upper "slinger" ribs or vanes for producing a slight suction in the area of the drive shaft seal in combination with providing a reservoir of liquid lubricant above the seal and drive shaft bearings for increasing the life of the seal and to enable quick and accurate detection of seal failure.

DETAILED DESCRIPTION

Figure 1:
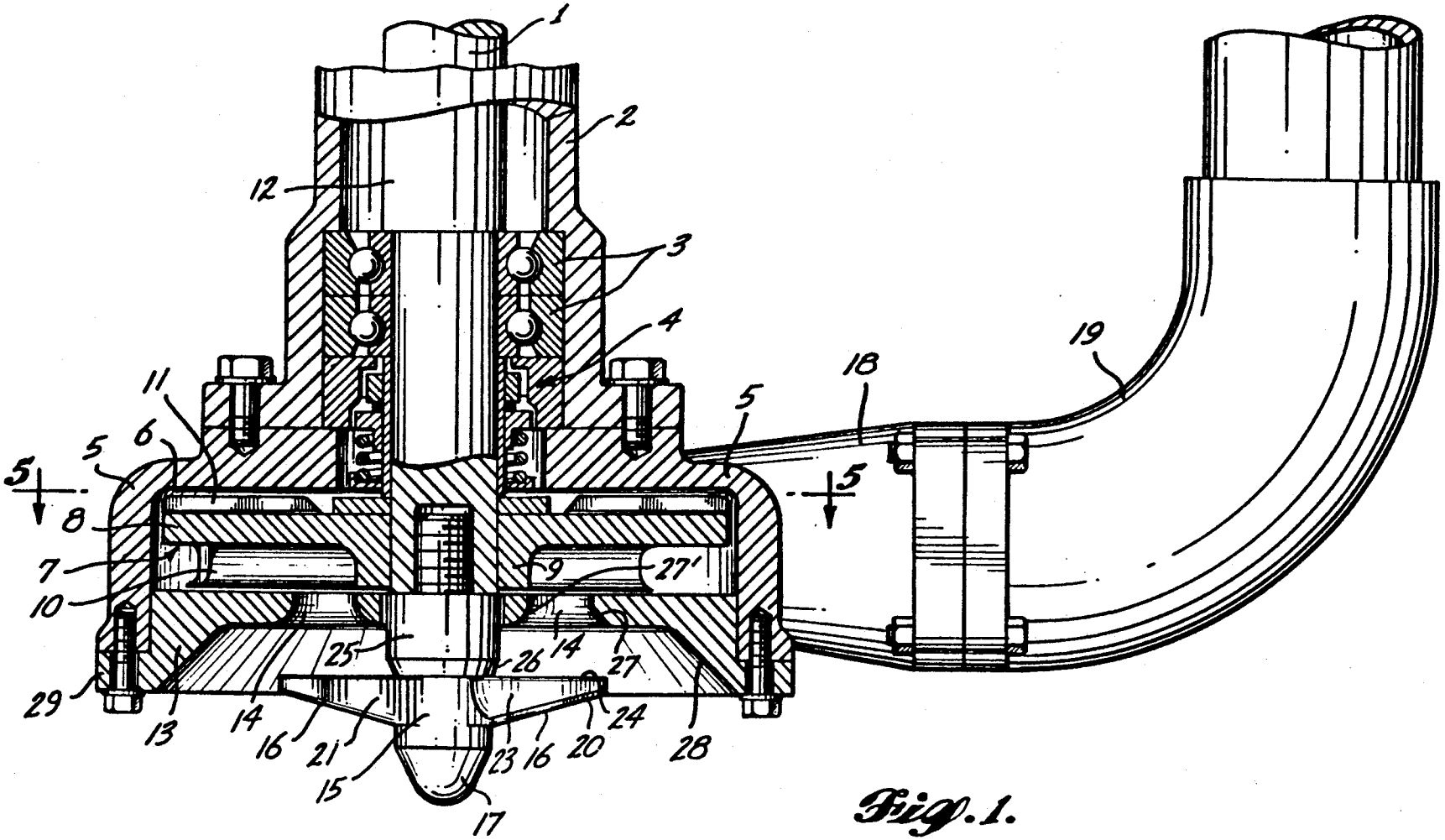
FIG. 1 is a side elevation of a centrifugal slicing slurry pump in accordance with the present invention with parts broken away and parts shown in section.

As indicated in FIG. 1, the centrifugal pump of the present invention includes an upright drive shaft 1 received within an upright housing 2 closely encircling the drive shaft. The annular space 12 between the drive shaft and the inner periphery of the upright housing forms a reservoir for oil or other lubricant. The bottom of the reservoir is closed by conventional antifriction bearings 3 for the drive shaft and a conventional seal 4.

The bottom portion of housing 2 is bolted to a pump casing 5 having a downward opening cavity or bowl 6 receiving the pump impeller 7. Such impeller consists of: a cylindrical shroud disc or plate 8 projecting radially from the impeller hub 9 fixed to the drive shaft; the primary pumping vanes or blades 10 projecting downward from the shroud plate; and vanes or ribs 11 projecting upward from the upper face of the shroud plate opposite the primary pumping blades 10.

Figure 2:
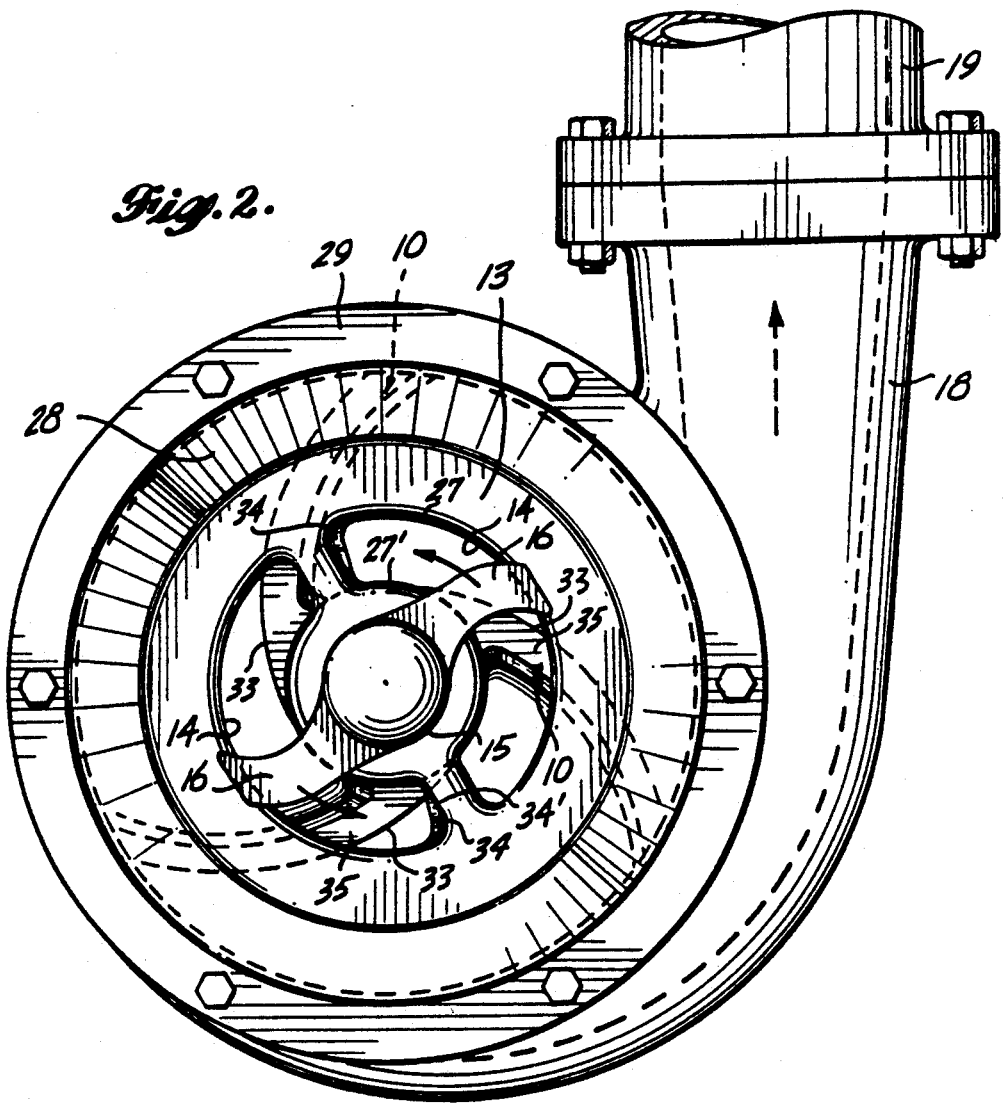
FIG. 2 is a bottom plan of the pump of FIG. 1.

The top of the pump bowl 6 is closed by the conventional seal encircling the drive shaft 1, and the bottom of the pump bowl is partially closed by an end plate 13 bolted to the bottom of the pump casing and having inlet apertures 14 which, as best seen in FIG. 2, are arcuate and concentric with the axis of rotation of the drive shaft and the impeller.

A disintegrator or booster propeller 15 having generally radially projecting, diametrally opposed blades 16 and a streamlined, convexly curved bottom cap 17 is fixed to the bottom end of drive shaft 1. Rotation of the drive shaft, such as by an electric motor, effects rotation of the booster propeller for propelling a slurry of liquid, usually water, and suspended solids constituting up to about 25 percent by weight of the slurry upward into the pump bowl through the arcuate inlet apertures 14 where the slurry is accelerated circumferentially and outward to the pump outlet conduit 18. Such outlet conduit extends generally tangentially from the impeller in its plane of rotation and is connected to a discharge conduit 19 for conveying the pumped slurry to a desired location.

The slurry pumped can include mixtures of water and, for example, earth or vegetable pulp, but the pump is particularly useful for pumping mixtures of water and animal waste such as manure. Such sewage slurries usually contain fairly large chunks or lumps of solid, sometimes stringy material which, to be pumped effectively, must be chopped or otherwise comminuted into relatively small pieces. Commonly the pump will be located near the bottom of a sump so that the slurry must be pumped upward a substantial distance. As a result, the pressure of the slurry at the pump outlet must be high, that is, the pump must operate at a high head.

Figure 3:
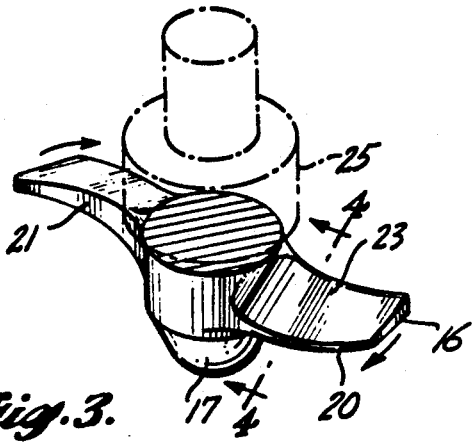
FIG. 3 is a somewhat diagrammatic, fragmentary, top perspective of a component of the pump of FIG. 1, namely, the disintegrator and booster propeller, showing its mounting structure in phantom.
Figure 4:
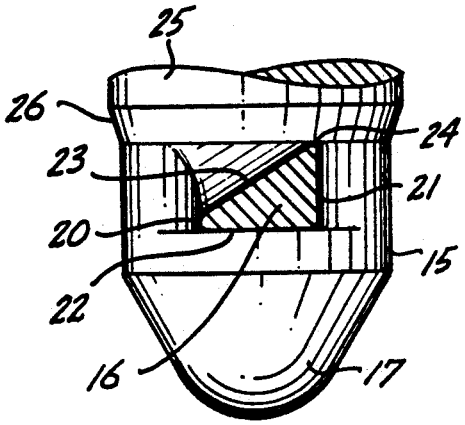
FIG. 4 is a section taken along line 4—4 of FIG. 3 but on a larger scale.

One factor that has been found to be important in increasing the head of a centrifugal slurry pump is the specific design of the disintegrator and booster propeller 15. The preferred design shown in FIGS. 2, 3 and 4 incorporates two generally radially extending, diametrally opposed blades 16 which, as shown in FIG. 2, are of substantially uniform circumferential width from their roots to their tips. As best seen in FIGS. 3 and 4, the leading edge 20 of each blade is thin for chopping or comminuting chunks or lumps of solid material in the slurry passing to the pump inlet. While the root portions of the blades project substantially radially from the propeller hub, the outer end portions of the blades are curved slightly rearward in the plane of rotation so that hard chunks or lumps of solid material will be impelled outward so as not to clog the pump inlet.

The transverse section of FIG. 4 illustrates the preferred cross-sectional shape for each propeller blade 16 throughout at least the major portion of its length. Its trailing side 21 is concave generally about an axis substantially parallel to the axis of rotation. For any transverse cross section an upright element of the trailing side 21 is substantially linear, preferably substantially parallel to the axis of rotation. Also for any transverse cross section, preferably a laterally extending element of the lower side 22 of the blade is substantially linear and lies in a plane substantially perpendicular to the propeller axis; and for any transverse cross section preferably a laterally extending element of the upper, slurry-propelling side 23 of the blade also is substantially linear or only slightly concavely curved and is inclined upward from the leading edge 20 of the blade to the upper edge 24 of the trailing side 21. Accordingly, throughout at least the major portion of its radial extent the blade is of generally triangular cross section, and, more specifically, of generally right triangular cross section.

In side elevation, as shown in FIG. 1, each blade 16 also is substantially triangular, the lower edge of the blade, defined by its cutting edge 20, appearing substantially linear and inclined upward from the root of the blade to its tip, and the upper edge 24 of the blade, defined by the junction of the trailing side 21 and the upper surface 23, appearing substantially linear and lying in a plane substantially perpendicular to the axis of rotation. Accordingly, each blade is tapered in axial extent substantially uniformly from its root to its tip.

As seen in FIG. 3, at the tip of a blade 16 the angle of the upper surface 23 to a radial plane is sharply acute. Progressing inward, the angle increases uniformly to the root of the blade and, since the blade is of substantially uniform circumferential width throughout its length, the propelling force generated by a rotating propeller blade is substantially uniform from the tip of the blade to its root because of the greater tip speed of the blade.

While each feature of the booster propeller is considered important, experiments have shown that of almost primary importance is that the blade be tapered in thickness from its trailing side 21 to its leading edge 20 and that the upright elements of the blade trailing side be substantially linear and, preferably, substantially parallel to the axis of rotation. Propellers substantially identical to the propeller shown in the drawings but having blades with convexly rounded trailing sides were much less effective in boosting the head of a centrifugal pump.

The head-increasing tendency of the propeller also is aided by locating it at the entrance to or substantially within an outwardly flared funnel 28 which can conveniently be formed as a recess in the pump end plate 13 leading to the arcuate inlet apertures 14. The sides of the funnel flare outward at an angle of about 45 degrees relative to the axis of rotation, and the axial depth of the funnel should be at least equal to the maximum axial extent of a blade 16 of the booster propeller 15. Such depth is about 10% to 15% of the diameter of the end plate. The maximum radius of the funnel should be at least about one and one-half times the radial extent of a blade 16. Slurry at the radially outer margin of the end plate is accelerated smoothly through the funnel toward the current generated by the booster propeller. Preferably the tips of the propeller blades extend to or slightly beyond the radially outer edges 27 of the arcuate inlet apertures which are faired by being rounded to assure a smooth flow into the pump. Similarly the radially inner edges 27' of the inlet apertures are rounded for smooth flow of slurry into the pump.

While it is preferred that the propeller be located at the entrance to or substantially within the end plate funnel 28, it also is preferred that the propeller be spaced downward from the inlet apertures a distance sufficient that it will not interfere with the slicing effectiveness of the impeller blades 10 and entry of slurry and small particles into the pump casing past the propeller. In the embodiment shown in the drawings, a cylindrical spacer 25 spaces the propeller downward from the flat inner portion of the end plate a distance only slightly less than the radial width of an inlet aperture. The lower portion of such spacer has a bevel 26 guiding the slurry toward the rounded radially inner edges 27' of the inlet apertures 14.

Figure 6:
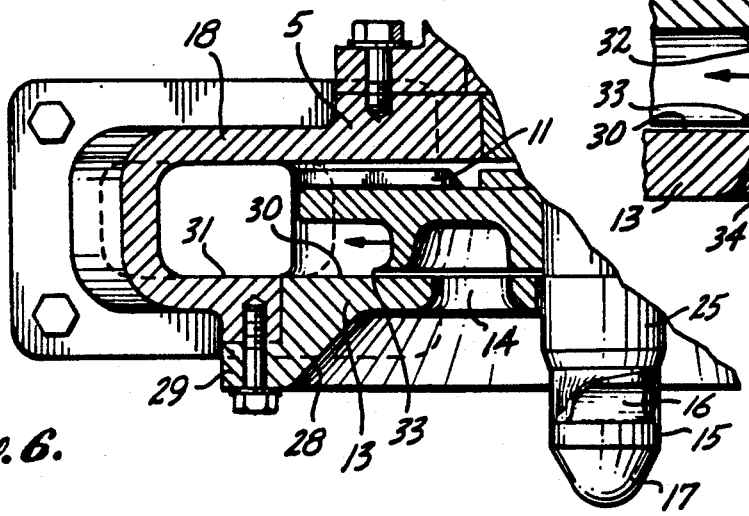
FIG. 6 is a fragmentary section taken on line 6—6 of FIG. 5.

For assuring a compact design, the apertured end plate 13 is received within the pump bowl and has a bottom annular flange 29 enabling the end plate to be bolted to the upright sides of the pump casing 5. As shown in FIG. 6, the primary advantage of recessing the end plate into the pump bowl is that the planar upper surface 30 of the end plate can be located flush with the lower side 31 of the pump outlet conduit 18 which is integral with the pump casing 5. In prior pumps, such as the pump of U.S. Pat. No. 3,973,866, an end plate extends across the lower edge of a pump casing having an integral outlet conduit, so that a substantial turbulence-promoting step occurs in the area of the entrance to such conduit.

To minimize backflow of high-pressure slurry in the pump casing 5 out the inlet apertures 14, such apertures are located as close to the center of the impeller as possible. The radially outer edges of the inlet apertures are positioned approximately midway between the axis of rotation and the radially outer tips of the primary pumping impeller blades 10. Preferably at least the major portion of the inlet aperture area is located within a circle having a radius one-half the radius of the circle defined by the rotating impeller blades.

Figure 5:
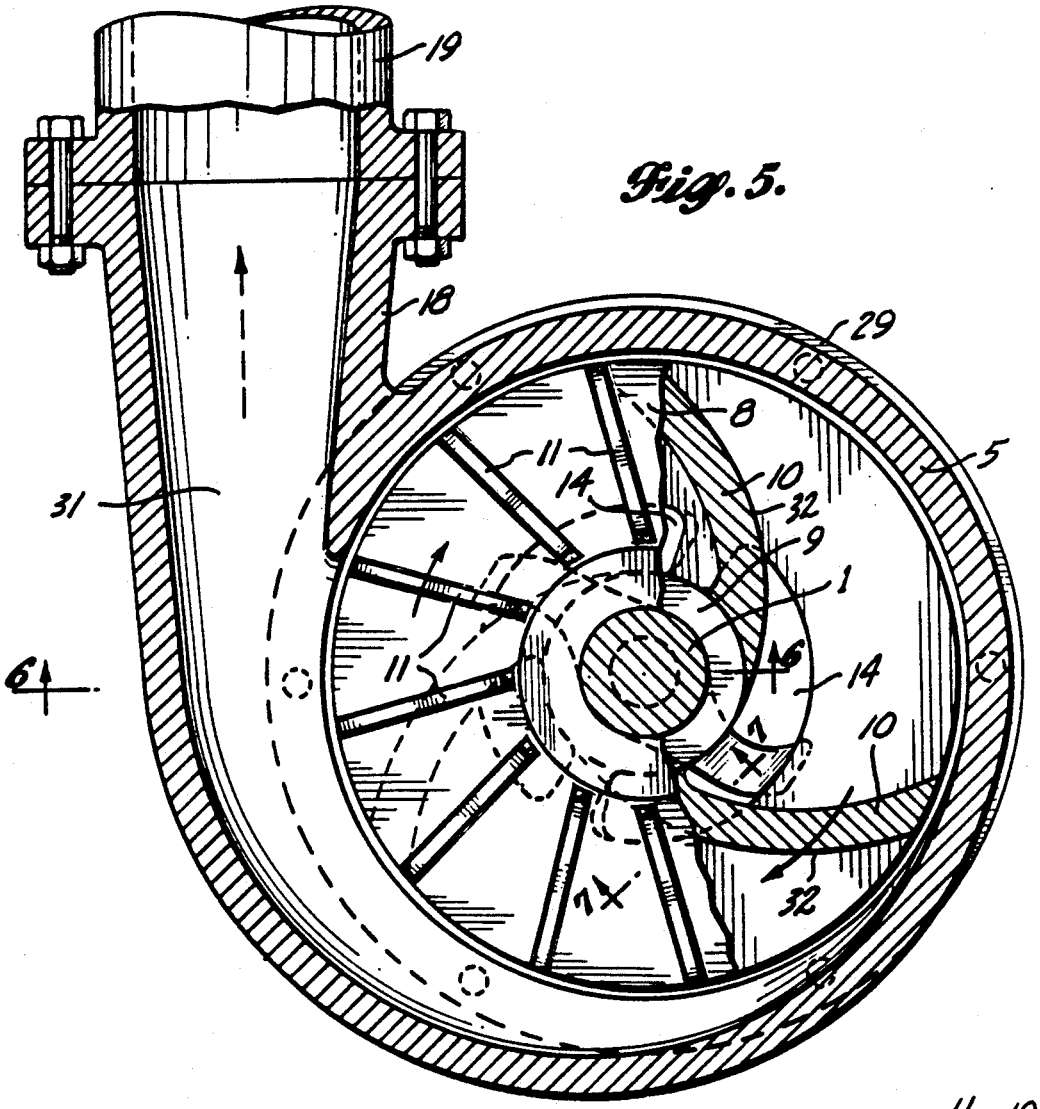
FIG. 5 is a section taken on line 5—5 of FIG. 1 with parts broken away.
Figure 7:
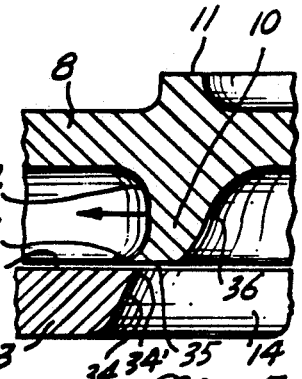
FIG. 7 is a fragmentary, detail section taken on line 7—7 of FIG. 5 on a larger scale with parts in different positions.

The specific design of the impeller also assures a high head and effective slicing action of chunks or lumps of solid material in the slurry being pumped. As best seen in FIGS. 5, 6 and 7, three primary pumping blades 10 are provided projecting downward from the shroud plate 8, each of substantially constant circumferential width throughout its length. Each blade is at least several times longer than its axial height and projects first generally tangentially from the impeller hub 9 and then is curved spirally rearward in the plane of rotation. As best seen in FIG. 7, the lower leading edge 33 of each blade is sharpened and is in close slicing relationship to the upper side 30 of the pump casing end plate 13. For this purpose the leading arcuate edges 34 of the end plate inlet apertures are beveled to a rearward facing sharpened edge 34' for close slicing contact with the leading edges of the blades.

Whereas prior centrifugal slurry pumps have used blades that project generally radially in the area of the inlet apertures for abrupt chopping of chunks or lumps of solid material in the slurry, the blades of the present invention are angled rearward in the area of the inlet apertures at a substantial angle relative to a radius, preferably at least 45°. As best seen in FIG. 2, the apparent movement of a blade as it approaches a sharpened leading edge 34' of an inlet aperture 14 is both forward and radially outward for effecting an angular slicing action, as opposed to an abrupt chopping action, of chunks or lumps of solid material in the slurry.

So that the primary impeller vanes 10 do not themselves interfere with entrance of slurry through the inlet apertures, it is preferred that the circumferential width of the blades be as small as possible at their lower sides 35, preferably no greater than one-half the radial width of the inlet apertures. As best seen in FIG. 7, however, the upper portions of the leading sides 32 and the trailing sides 36 of blades should be faired gently into the shroud plate by fillets extending from about the axial center of each blade for smooth change of flow direction of the slurry from a generally axial direction to accelerated movement in the plane of rotation. As a result of the fairing, the blades are tapered in circumferential width from their roots to their tips such that the circumferential width of each blade at its tip is no greater than about one-half the circumferential width of the blade at its root. In combination with the fairing of the leading side 32 of the blade into the shroud plate, the forward curved lower tip portion of the blade leading to the sharpened cutting edge 33 forms a substantial forward opening cup that is swept spirally rearward in the plane of rotation for effective but smooth acceleration of the slurry circumferentially forward and outward toward the pump outlet. As shown in FIG. 7, the fairing of the trailing side 36 of the blade into the shroud plate 8 is more gradual than the fairing of the leading side 32 into such plate, that is, the radius of curvature of the fillet formed at the upper portion of the trailing side is greater than the radius of curvature of the fillet formed at the upper portion of the leading side.

The axially short ribs or vanes 11 projecting upward from the shroud plate are provided primarily to protect the seal encircling the drive shaft rather than to assist in pumping the slurry. Such vanes are substantially shorter than the primary pumping vanes 10, and more upper vanes 11 are provided at closer spacing. Rather than being volute or curved rearward in the plane of rotation, such upper vanes 11 are substantially straight though angled rearward as to be generally tangential to the periphery of the drive shaft 1. As with the lower primary pumping blades 10, such upper vanes 11 are faired into the shroud plate by fillets extending from at least about their axial centers as shown in FIG. 7.

The overall design of the upper vanes 11 results in development of higher pressure at the periphery and above the shroud plate 8 than below it so that there is some suction above the plate away from the seal. Accordingly, lubricant from the reservoir in housing 2 tends to be drawn through the bearings 3, and the seal, assuring longer life than if a positive pressure were exerted above the shroud plate toward the seal which could force slurry through the seal and bearings into the lubricant housing. In addition, as seen in FIG. 1, the entire extent of the upright annular lubricant reservoir 12 is located above the bearings 3 and seal 4 such that gravity assists in urging lubricant toward the bearings and seal failure is quickly and accurately detected by a rapid decrease in the level of lubricant in the reservoir formed by the housing.

A final factor affecting the head of the pump is the design of the pump casing 5. As shown in FIG. 5, rather than being spiraled or volute throughout its circumference, that is, rather than having a progressively increasing radial extent between the casing and the radially outer ends of the pump blades in the direction of rotation, such casing is semicylindrical and semivolute. Beginning at the the outlet conduit 18 and moving opposite the direction of rotation, for about one-half the circumference of the impeller the casing spirals inward toward the shroud plate, and for the final one-half of its circumference the casing closely encircles the shroud plate providing a semi-cylindrical zone. Since slurry cannot escape outward in the semicylindrical zone, pressure of the slurry increases substantially in this zone before the slurry can escape circumferentially toward the outlet conduit and, as a result, the head of the pump is substantially increased.

I claim:

1. In a centrifugal pump, the improvement comprising the combination of an upright rotatable drive shaft defining an axis, an impeller mounted on the lower end portion of said drive shaft, said impeller having a generally radial shroud plate and first and second sets of vanes projecting, respectively, generally axially in opposite directions from said shroud plate, a pump casing including a bowl encircling said impeller, said casing having a bottom inlet end adjacent to and below said first set of impeller vanes and a top end adjacent to and above said second set of impeller vanes, seal means encircling said drive shaft for sealing said top end of said pump casing, antifriction bearing means directly above said seal means for journaling said drive shaft and positioning it relative to said casing, a liquid lubricant reservoir outside said pump casing and in communication with said bearing means and said seal means, a column of liquid lubricant in said reservoir, an upright housing encircling said drive shaft, said housing being connected to said casing adjacent to said top end of said casing and extending upward therefrom, said housing having an inner periphery spaced outward from said drive shaft and forming said lubricant reservoir directly above said seal means such that said column of liquid lubricant in said reservoir is biased downward by gravity through said bearing means to said seal means, said first and second sets of impeller vanes being constructed and arranged relatively so that during rotation of said impeller suction toward said bowl is generated at the location of said seal means tending to draw lubricant from said reservoir to said bearing means and said seal means.

2. In the pump defined in claim 1, the vanes of the second set of impeller vanes being shorter and more closely spaced than the vanes of the first set of impeller vanes, the vanes of the second set extending generally radially along the side of the shroud plate adjacent to the top end of the casing, each vane of the second set extending a distance constituting at least the major portion of the radius of the shroud plate.

3. In the pump defined in claim 2, the axial height of each of the vanes of the second set being about the same as the circumferential thickness of such vane.

* * * * *